US008511863B2

(12) United States Patent
Masuda et al.

(10) Patent No.: US 8,511,863 B2
(45) Date of Patent: Aug. 20, 2013

(54) LUMINAIRE

(75) Inventors: Toshifumi Masuda, Kanagawa-ken (JP); Kazunari Higuchi, Kanagawa-ken (JP); Ryotaro Matsuda, Kanagawa-ken (JP)

(73) Assignee: Toshiba Lighting & Technology Corporation, Kanagawa-ken (JP)

( * ) Notice: Subject to any disclaimer, the term of this patent is extended or adjusted under 35 U.S.C. 154(b) by 0 days.

(21) Appl. No.: 13/427,376

(22) Filed: Mar. 22, 2012

(65) Prior Publication Data

US 2012/0243243 A1 Sep. 27, 2012

(30) Foreign Application Priority Data

Mar. 25, 2011 (JP) ..... 2011-068875

(51) Int. Cl.
*F21V 29/00* (2006.01)

(52) U.S. Cl.
USPC ..... 362/294; 362/368; 362/373

(58) Field of Classification Search
USPC ..... 362/145, 147, 294, 364, 365, 368, 362/373, 382; 165/80.1, 80.2, 80.3
See application file for complete search history.

(56) References Cited

U.S. PATENT DOCUMENTS

| | | | | |
|---|---|---|---|---|
| 4,419,716 | A * | 12/1983 | Koo | 362/96 |
| 5,420,769 | A * | 5/1995 | Ahlgren et al. | 362/294 |
| 2008/0130298 | A1 * | 6/2008 | Negley et al. | 362/365 |
| 2008/0158876 | A1 | 7/2008 | Thrailkill | |
| 2009/0067172 | A1 | 3/2009 | Inoue | |
| 2010/0038657 | A1 | 2/2010 | Higuchi | |
| 2010/0195327 | A1 | 8/2010 | Inoue | |
| 2010/0195328 | A1 | 8/2010 | Inoue | |
| 2010/0195329 | A1 | 8/2010 | Inoue | |
| 2010/0226131 | A1 | 9/2010 | Higuchi | |
| 2011/0222291 | A1 * | 9/2011 | Peng | 362/294 |

FOREIGN PATENT DOCUMENTS

| | | |
|---|---|---|
| CN | 101713529 | 5/2010 |
| EP | 2034234 | 3/2009 |
| EP | 2226554 | 9/2010 |
| JP | 2008-159455 | 7/2008 |
| JP | 2010-073654 | 2/2010 |

OTHER PUBLICATIONS

English Language Abstract of JP 2010-073654 published Feb. 4, 2012.
English Language Tranlsation of JP 2010-073654 published Feb. 4, 2012.
Extended European Search Report issued in EP 12160693.3 oon Feb. 13, 2013.
English Language Abstract of CN 101713529 published on May 26, 2010.
English Language Abstract of JP 2008-159455 published on Jul. 10, 2008.
English Language Translation of JP 2008-159455 published on Jul. 10, 2008.

* cited by examiner

*Primary Examiner* — Thomas Sember
(74) *Attorney, Agent, or Firm* — DLA Piper LLP

(57) ABSTRACT

According to an embodiment, a luminaire includes a thermal radiation member, and a light source unit provided on a front side of the thermal radiation member. The thermal radiation member has plural support walls provided on a rear surface radially about a substantially central portion of the rear surface toward an outer periphery, and plural thermal radiation fins provided on the rear surface, being away from each other and substantially parallel to each other toward the outer periphery from neighboring wall surface sides of the plural support walls. The light source unit includes a light-emitting element.

4 Claims, 10 Drawing Sheets

LUMINAIRE

CROSS-REFERENCE TO RELATED APPLICATION

This application is a U.S. National Stage Application of International Patent Application No. PCT/JP2011/072633 filed Sep. 30, 2011. International Patent Application No. PCT/JP2011/072633 claims priority to Japanese Patent Application No. 2010-228499 filed Oct. 8, 2010. This entirety of both of the above-listed applications are incorporated herein by reference.

FIELD

Embodiments described herein relate generally to a luminaire.

BACKGROUND

Recently, with higher output, higher efficiency and broader use of light-emitting elements such as light-emitting diodes (LED), luminaires have been developed using light-emitting elements which are expected to have a longer life. For example, LEDs are increasingly used as a light source of a downlight.

The light-emitting element such as the LED has a lower light output and a shorter service life as the temperature thereof increases. Therefore, for a luminaire using a solid-state light-emitting element such as LED or electroluminescent (EL) element as a light source, temperature rise of the light-emitting element needs to be restrained in order to extend the service life and to improve characteristics such as light-emitting efficiency.

Thus, in the luminaire using the LED as a light source, a light source unit is arranged on a front side (light irradiating side) of a heat-conductive main body and plural thermal radiation fins are provided on a rear side. Thus, thermal radiation performance is facilitated and temperature rise in the light-emitting element is restrained.

DETAILED DESCRIPTION

Figure 1:
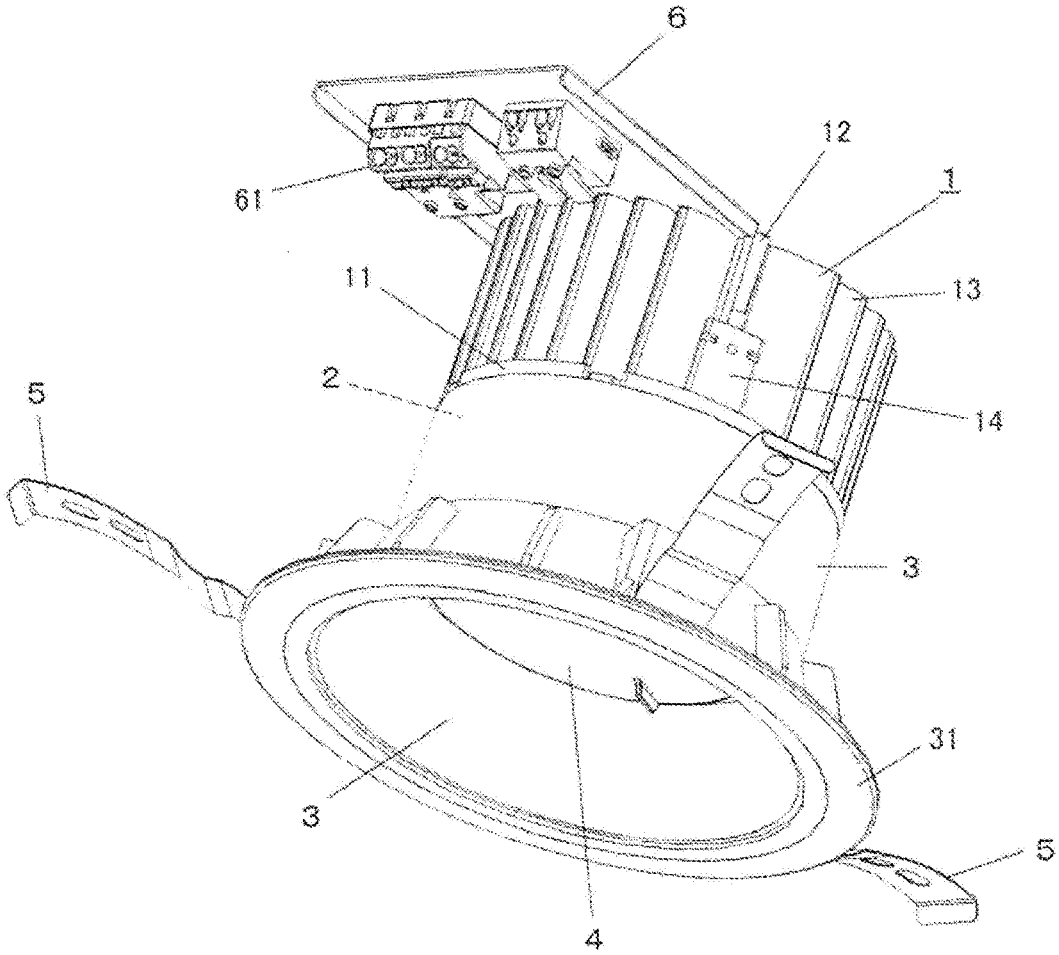
FIG. 1 is a perspective view showing a luminaire according to a first embodiment.
Figure 2:
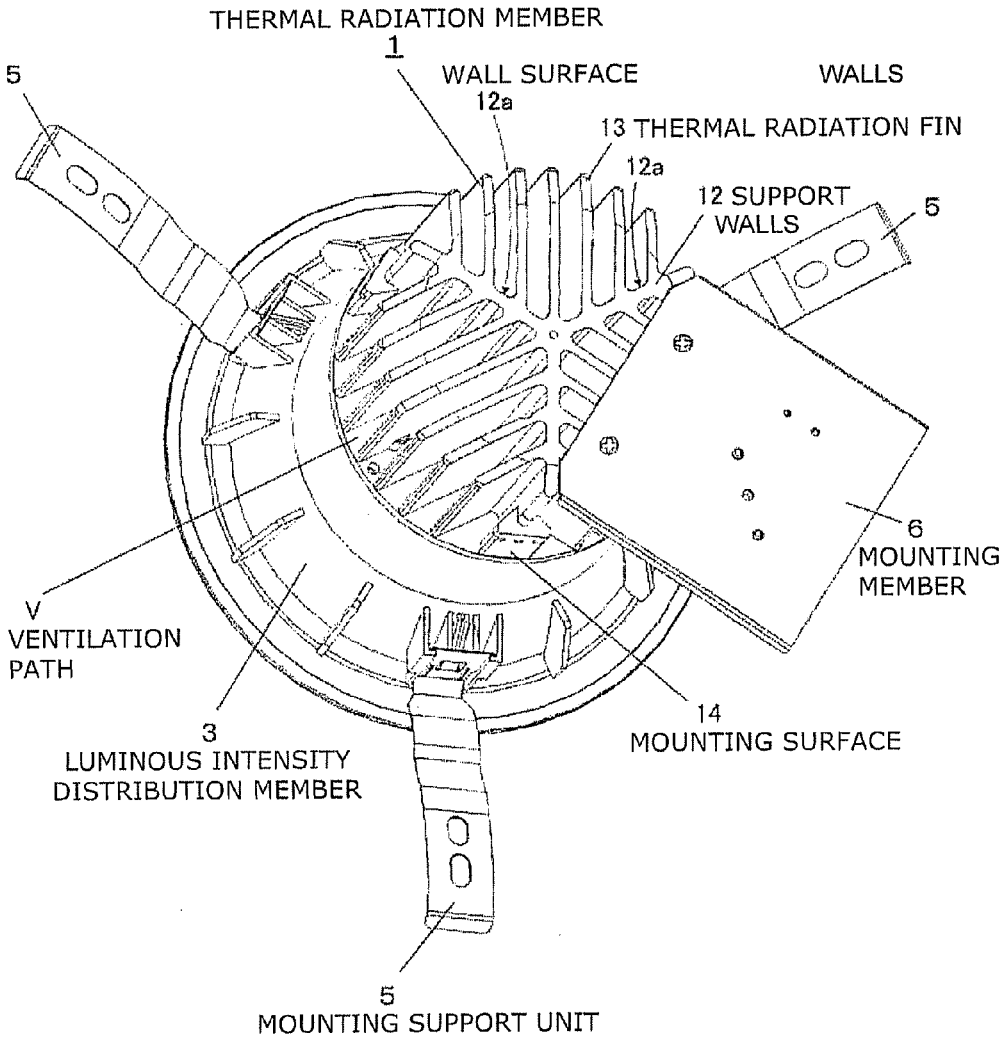
FIG. 2 is a perspective view showing the luminaire as viewed from the rear side.
Figure 3:
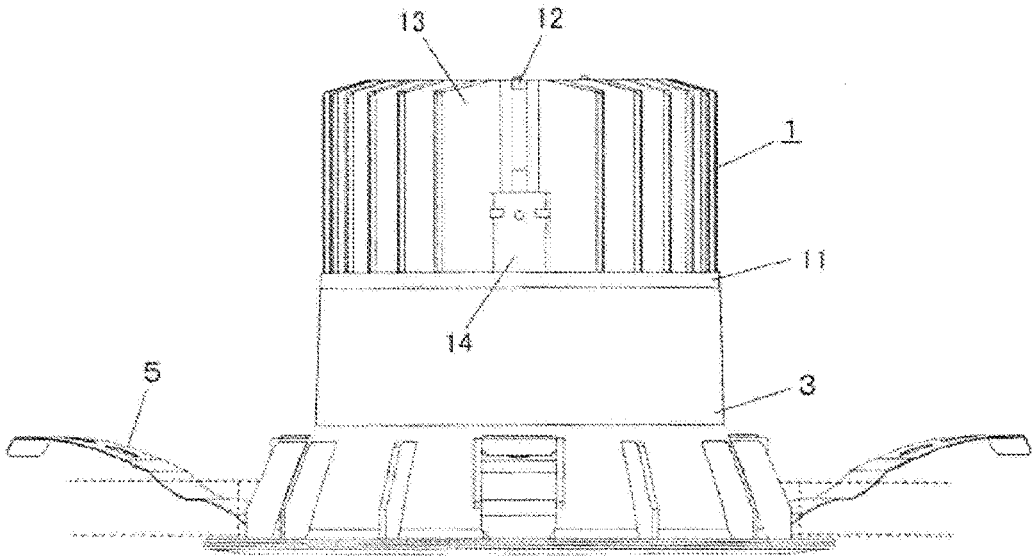
FIG. 3 is a front view showing the luminaire.
Figure 4:
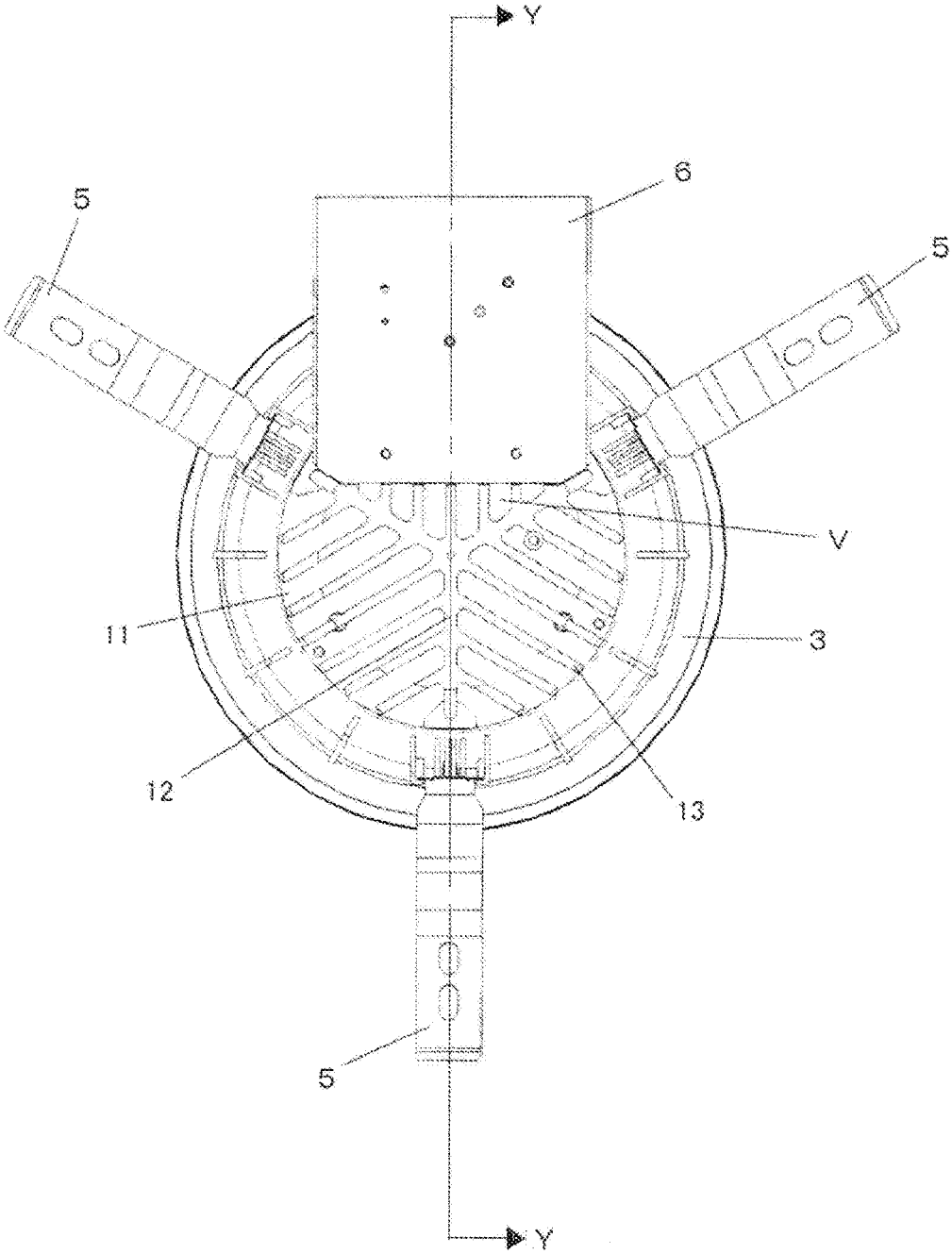
FIG. 4 is a plan view showing the luminaire as viewed from the rear side.
Figure 5:
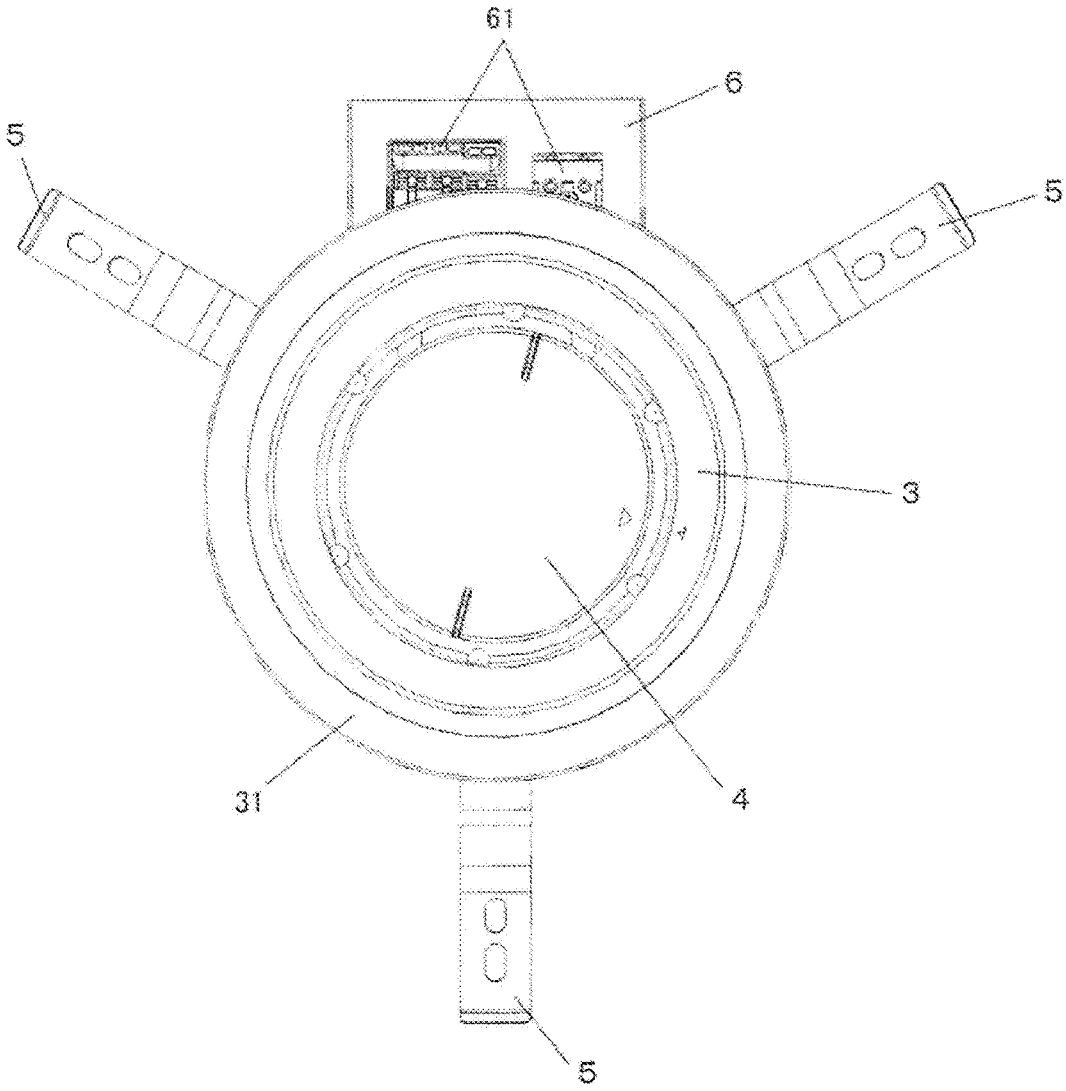
FIG. 5 is a plan view showing the luminaire as viewed from the front side.
Figure 6:
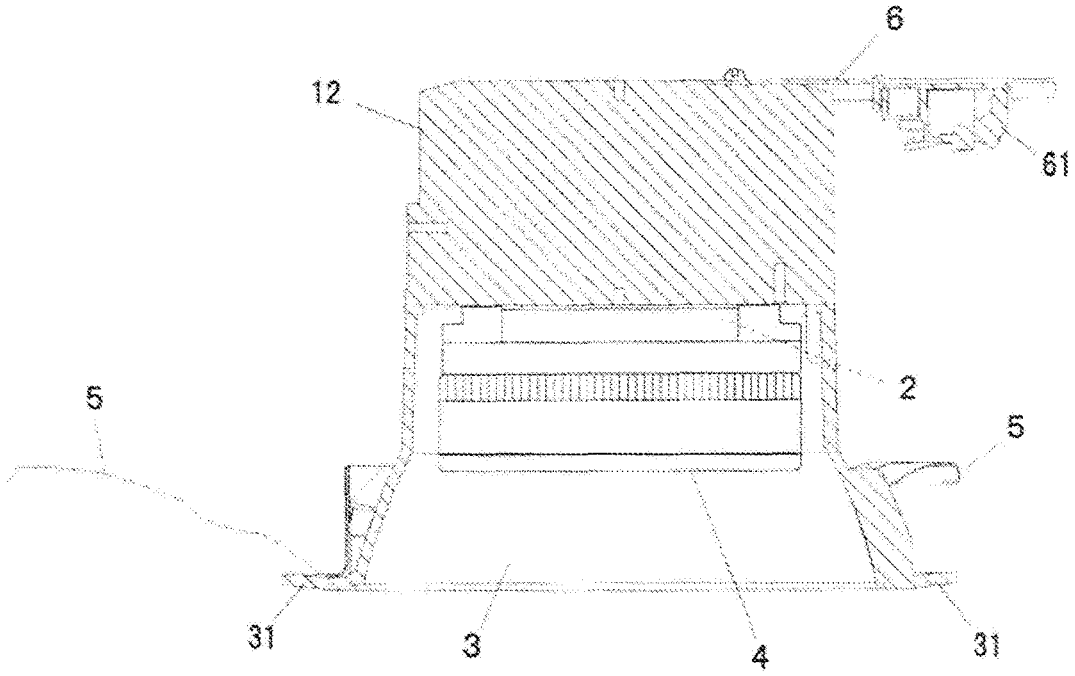
FIG. 6 is a sectional view showing a portion along a line Y-Y in FIG. 4 (excluding a light source unit and the like).

When improved thermal radiation performance is required because of higher output of a light-emitting element such as an LED, thermal radiation performance is typically improved by increasing the size of a main body or by increasing the height dimension of each thermal radiation fin. Therefore, a luminaire tends to be increased in size.

According to one embodiment, a luminaire includes a thermal radiation member, and a light source unit provided on a front side of the thermal radiation member. The thermal radiation member has plural support walls provided on a rear surface radially about a substantially central portion of the rear surface toward an outer periphery, and plural thermal radiation fins provided on the rear surface, being away from each other and substantially parallel to each other toward the outer periphery from neighboring wall surface sides of the plural support walls. The light source unit includes a light-emitting element.

Hereinafter, a luminaire according to a first embodiment will be described with reference to FIG. 1 to FIG. 9. In the drawings, the same parts are denoted by the same reference numerals and duplicate explanation thereof is not given.

The luminaire according to the embodiment is a downlight of a type that is embedded and thus installed in a ceiling.

The downlight includes a luminaire main body 1 as a thermal radiation member, a light source unit 2, a luminous intensity distribution member 3, a cover member 4, mounting springs 5 as mounting support members for mounting the luminaire main body, a mounting member 6 for mounting a terminal block, as shown in FIG. 1, and a power supply unit, not shown.

The luminaire main body 1 is heat-conductive and is produced by die cast molding of a highly heat-conductive material, for example, an aluminum alloy. The light source unit 2 is directly or indirectly provided on a front side (light irradiating side) of this luminaire main body 1. High thermal conductive film may be provided between the luminaire main body 1 and the light source unit 2.

As shown in FIG. 1, FIG. 2, FIG. 7 and FIG. 8, the luminaire main body 1 has a base unit 11, plural support walls 12 provided extending vertically from a rear surface of the base unit 11, and plural thermal radiation fins 13 provided extending vertically from the rear surface of the base unit 11 similarly to the support walls 12. The base unit 11, the support walls 12 and the thermal radiation fins 13 are integrally formed.

The base unit 11 is formed in the shape of a substantially circular plate. On a front side of the base unit 11, the light source unit 2, described later, is thermally coupled and arranged.

Figure 7:
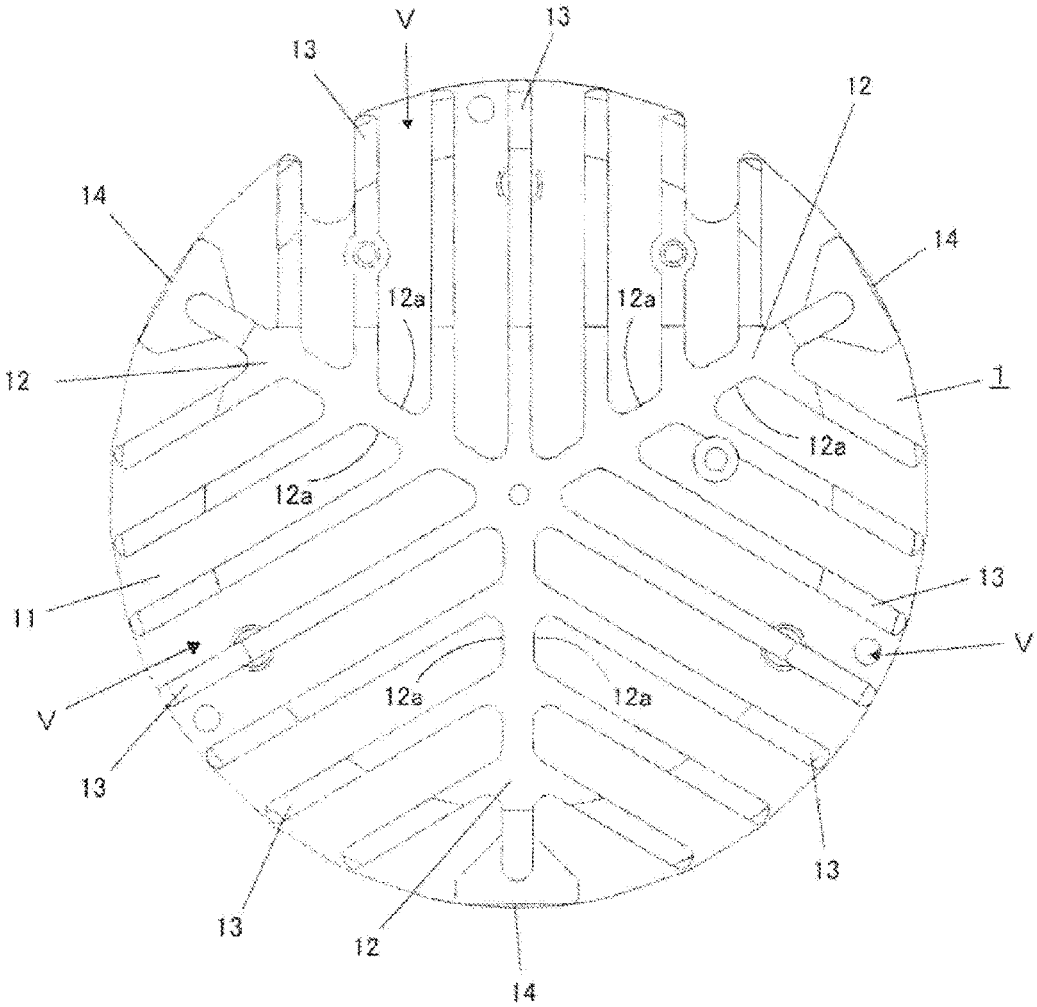
FIG. 7 is a plan view showing a thermal radiation member of the luminaire as viewed from the rear side.
Figure 8:
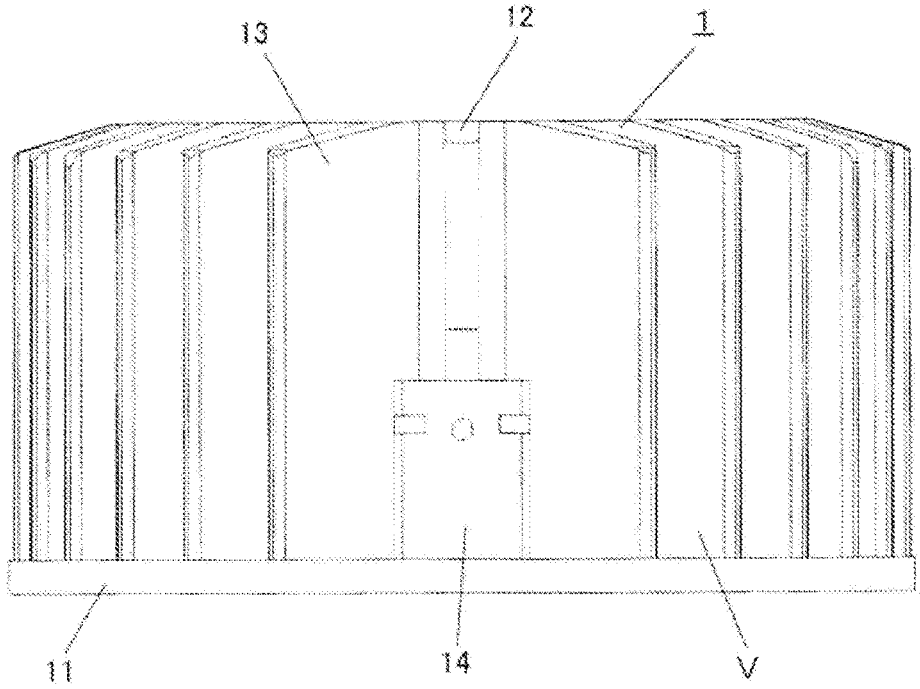
FIG. 8 is a front view showing the thermal radiation member of the luminaire.

As shown in FIG. 7 as a representative drawing, the plural support walls 12 are extended and formed radially about a substantially central portion of the rear surface of the base unit 11 toward an outer periphery. Specifically, the support walls 12 are formed at substantially equal intervals of substantially 120 degrees about the substantially central portion of the base unit 11. That is, three support walls 12 are radially formed.

The thermal radiation fins 13 extend toward the outer periphery from the side of neighboring wall surfaces 12*a* of the plural support walls 12 and are away from each other by a predetermined spacing. Also, the thermal radiation fins 13 are arranged substantially parallel to each other.

Therefore, the plural thermal radiation fins 13, specifically seven radiation fins 13, are arranged between the wall surfaces 12*a* of the neighboring support walls 12. If this is considered one block, three blocks are formed and 21 thermal radiation fins 13 are arranged.

In this manner, the support walls 12 are formed radially toward the outer periphery and the thermal radiation fins 13 are formed toward the outer periphery, being away from each other and substantially parallel to each other. Therefore, ventilation paths V between the thermal radiation fins 13 are formed over the entire circumference of the base unit 11. Also at the central portion of the base unit 11, the thermal radiation fins 13 are formed away from each other and substantially parallel to each other, thus forming ventilation paths V at predetermined intervals.

Figure 10:
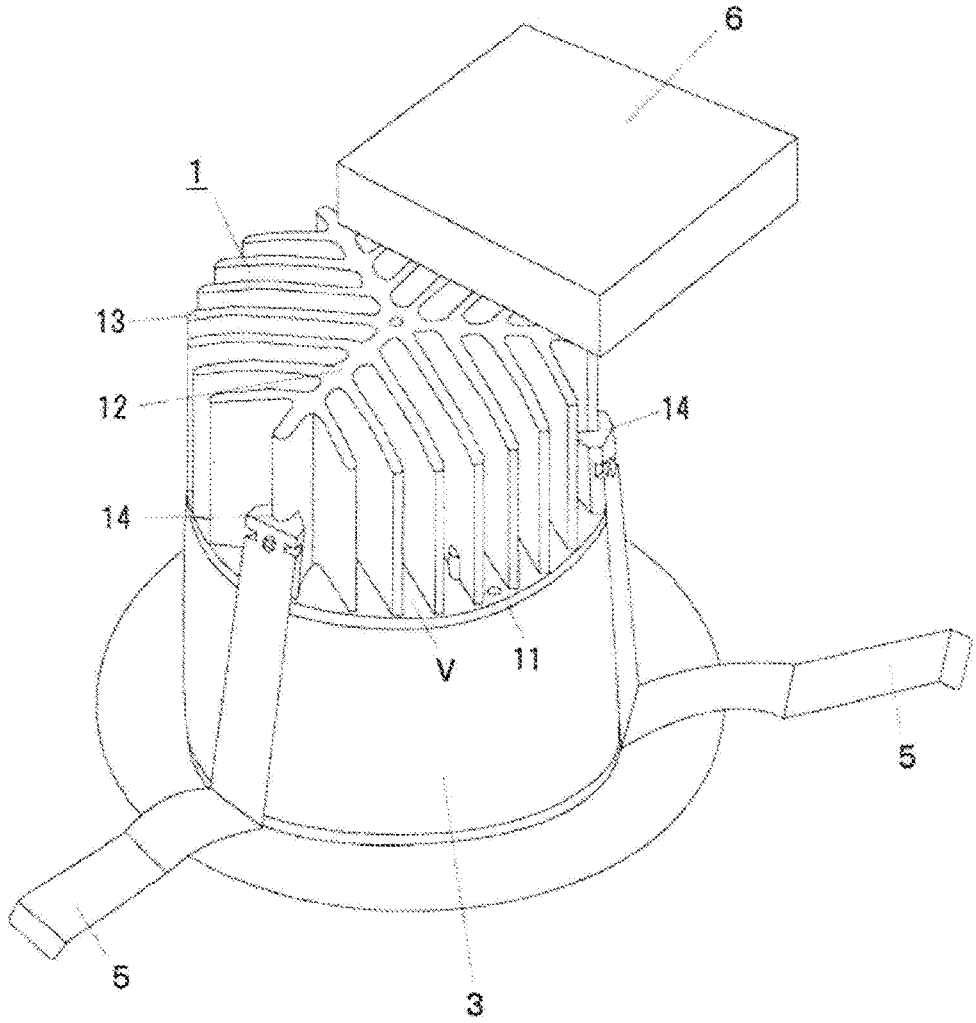
FIG. 10 is a perspective view showing a luminaire according to a second embodiment.

On an outer peripheral side of the support walls 12, mounting surfaces 14 on which mounting springs 5 for installing the luminaire main body can be mounted are formed, as will be described later with reference to FIG. 10. The mounting surfaces 14 are formed in the shape of a flat surface so that the mounting springs 5 can be fixed stably.

The entire surface of the luminaire main body 1 can be preferably treated with alumite in order to improve emissivity and to increase the thermal radiation amount.

The light source unit 2 is a light-emitting module. Although not shown in detail, the light source unit 2 includes a substrate, plural LED bare chips as light-emitting elements mounted on a face side of the substrate, a sealing resin layer containing a phosphor applied to cover the plural LED bare chips, and a heat-conductive mounting plate on which the substrate is mounted.

In this embodiment, the substrate is formed as a flat plate of aluminum that is highly heat-conductive. As the plural LED bare chips, for example, LED bare chips which emit blue light are used so that a light-emitting unit emits white-based light. The sealing resin layer is made of a light-transmissive synthetic resin, for example, a transparent silicone resin having predetermined elasticity. The sealing resin layer is a phosphor layer containing an appropriate amount of a phosphor such as YAG:Ce. The phosphor is excited by light emitted from the LED and radiates light of a different color from the color of the light emitted from the LED. In this embodiment, where the LED emits blue light, a yellow phosphor that radiates yellow-based light which is a complementary color to the blue light is used in order to enable emission of white light.

For the light-emitting elements as the light source, a surface-mounted LED package may be used and the form thereof is not particularly limited.

In this light-emitting module, the heat-conductive mounting plate is arranged in contact with the front side of the luminaire main body 1 and thermally coupled therewith.

On the front side of the light source unit 2, the light-transmissive cover member 4 mounted on a cylindrical holder is arranged to cover the light source unit 2. The cover member 4 is circular and is made of a diffusion-treated synthetic resin material such as polycarbonate.

The luminous intensity distribution member 3 has a cylindrical portion and is formed in a sloped shape in a manner that enlarges from the cylindrical portion toward the front side. The luminous intensity distribution member 3 is made of a synthetic resin material, for example, polycarbonate or ABS resin, and appears white. At a substantially circular opening end of the expansion toward the front side, of the luminous intensity distribution member 3, an annular flange 31 extending toward the outer periphery is integrally formed as an ornamental frame.

The luminous intensity distribution member 3, thus configured, is arranged surrounding the periphery of the light source unit 2. The luminous intensity distribution member 3 has a function of controlling luminous intensity distribution of light emitted from the light source unit 2, with the sloped form expanding toward the front side, and for example, has a function of restraining glare.

The mounting springs 5 as the mounting support members for installing the luminaire main body are mounted at three positions at equal intervals of substantially 120 degrees on an outer peripheral part on the opening side of the luminous intensity distribution member 3.

The mounting member 6 for mounting a terminal block is made of a metallic plate member such as a zinc-plated steel sheet and is substantially quadrilateral. A terminal block 61 is mounted on a back side of the mounting member 6. A power supply line, a signal line and the like led out from the power supply unit, not shown, are connected to the terminal block 61.

One end side of the mounting member 6 is mounted on the thermal radiation fins 13. Specifically, the mounting member 6 is mounted in such a manner as to be placed on a rear-side end part of the thermal radiation fins 13 and is not extended to a central portion on the rear side of the thermal radiation fins 13.

Therefore, the mounting member 6 does not close the ventilation paths V formed by the thermal radiation fins 13, over the entire surface on the rear side. That is, the mounting member 6 is mounted, leaving some of the ventilation paths V and without covering the rear side entirely so that the ventilation paths V are secured.

Thus, the ventilation paths V secure convection of air flowing in from outside and forming an updraft toward the rear side.

The power supply unit is installed on the back side of the ceiling. The power supply unit is connected to a commercial power supply and has a lighting circuit and a connection terminal. The power supply unit is electrically connected with the light-emitting module, which is the light source unit 2, via the terminal block 61. The lighting circuit includes, for example, a full-wave rectifier circuit, a smoothing capacitor connected between output terminals of the full-wave rectifier circuit, and a DC voltage converter circuit and a current detector connected to the smoothing capacitor. The lighting circuit supplies power to the light-emitting module and controls lighting of the light-emitting elements.

To install such a downlight, the power supply unit is inserted through a recess hole and arranged on the back side of the ceiling. Next, an operation to compress the mounting springs 5 against an elastic force thereof is carried out with both hands, and the luminaire main body 1 is thus supported and inserted through the recess hole. As the luminaire main body 1 is inserted in the recess hole, the hands are released and the luminaire main body 1 is pushed up. Thus, the mounting springs 5 return outward and abut on the back side of the ceiling. This elastic force pulls the luminaire main body 1 upward and the flange 31 of the luminous intensity distribution member 3 is pressed in contact with a peripheral edge of the recess hole. The luminaire main body 1 is thus installed on the ceiling surface.

Next, the operation in the embodiment will be described. As the power supply unit is electrified, the light-emitting module of the light source unit 2 is supplied with power and therefore the light-emitting elements emit light. Most of the light emitted from each light-emitting element is transmitted through the light-transmissive cover member 4 and is cast forward. The luminous intensity distribution member 3 performs overall luminous intensity distribution control of the light that is cast forward, and the light is then cast toward the front side.

Heat is generated during light emission by the light-emitting elements. The heat generated from the light-emitting elements is mainly transmitted to the luminaire main body 1 from the back side of the light-emitting module. This heat is conducted from the base unit 11 of the luminaire main body 1 to the support walls 12 and the thermal radiation fins 13 and is radiated, accompanying the convection generated in the ventilation paths V formed by the arrangement of the thermal radiation fins 13 being away from each other and substantially parallel to each other.

In this case, since the ventilation paths V are formed between the thermal radiation fins 13 over the entire circumference of the luminaire main body 1, air flows in from the entire circumference and forms an updraft toward the rear side, thus generating convection. Meanwhile, temperature tends to rise at the central portion of the base unit 11 because of the heat generated from the light-emitting module. However, since the ventilation paths V at predetermined intervals are secured even in the central portion, convection can occur and increase the thermal radiation effect.

Since the support walls 12 and the thermal radiation fins 13 are integrally formed, heat is conducted to the thermal radiation fins 13 from the side of the base unit 11 and heat is conducted thereto also from the support walls 12. Thus, improvement in thermal radiation performance can be expected.

Moreover, the mounting member 6 does not close the entire rear side of the thermal radiation fins 13. Therefore, hindrance to thermal radiation performance due to the mounting member 6 can be restrained.

As described above, according to this embodiment, a luminaire can be provided in which improvement in thermal radiation performance, effective restraining of temperature rise in the light-emitting elements and restraining of increase in size of the luminaire main body 1 can be realized.

Figure 9:
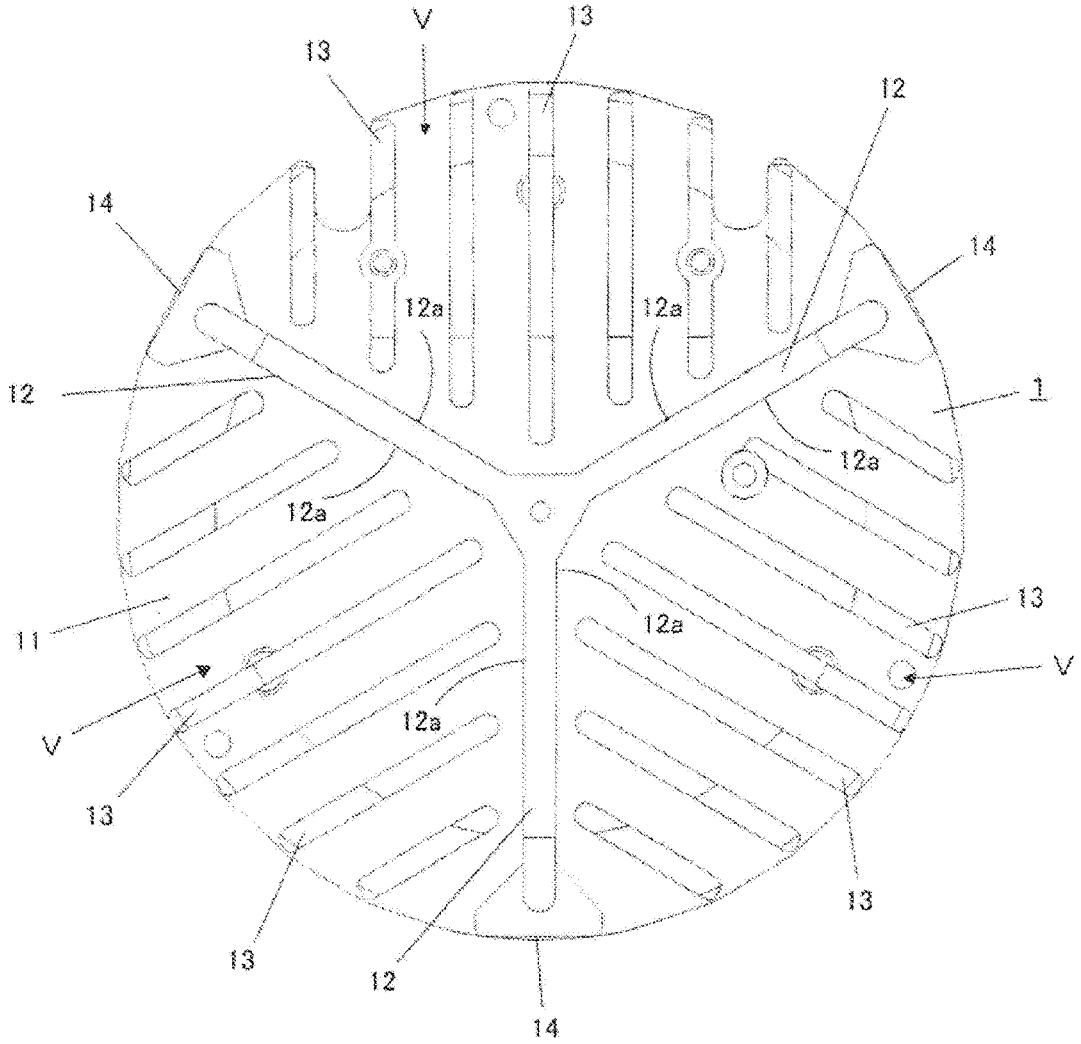
FIG. 9 is a plan view showing a modification of the thermal radiation member as viewed from the rear side.

Next, a modification of the luminaire main body 1 will be described with reference to FIG. 9. As in the embodiment, the thermal radiation fins 13 extend toward the outer periphery from the side of the neighboring wall surfaces 12*a* of the plural support walls 12.

However, the thermal radiation fins 13 are not formed integrally with the support walls 12. That is, the thermal radiation fins 13 are formed slightly away from the wall surfaces 12*a* of the support walls 12.

Even in this case, the ventilation paths V are secured between the thermal radiation fins 13 over the entire circumference of the luminaire main body 1, and the ventilation paths V are also secured in the central portion of the base unit 11. Therefore, convection generated in the ventilation paths V can improve the thermal radiation effect.

Next, a luminaire according to a second embodiment will be described with reference to FIG. 10. The same parts or equivalent parts as in the first embodiment are denoted by the same reference numerals and duplicate explanation thereof is not given. In the second embodiment, a different type of downlight from the downlight of the first embodiment is described. The configuration of the luminaire main body 1 as the thermal radiation member is similar to the first embodiment.

A main difference is that, in the first embodiment, the mounting springs 5 as the mounting support member are mounted on the outer peripheral part on the opening side of the luminous intensity distribution member 3, whereas in this embodiment, the mounting springs 5 are mounted on the mounting surfaces 14 formed on the outer peripheral side of the support walls 12.

According to this configuration, in addition to the advantages of the first embodiment, achievement of good weight balance and improved workability in installing the downlight can be expected since the weighty luminaire main body 1 is directly supported by the mounting springs 5.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A luminaire comprising:

a thermal radiation member comprising plural support walls provided on a rear surface extending radially from a substantially central portion of the rear surface toward an outer periphery, and plural thermal radiation fins provided on the rear surface, being disposed apart from each other and substantially parallel to each other and extending toward the outer periphery from neighboring wall surface sides of the plural support walls; and a light source unit including a light-emitting element and provided on a front side of the thermal radiation member.

2. The luminaire according to claim 1, wherein the support walls and the thermal radiation fins are integrally formed.

3. The luminaire according to claim 1, further comprising a mounting member with a terminal block mounted thereon provided at a rear surface side end part of the thermal radiation fins, wherein the mounting member is not extended to the central portion of the rear surface side of the thermal radiation member.

4. The luminaire according to claim 1, further comprising a mounting surface, on which a mounting support member for installing a luminaire main body can be mounted, provided on an outer peripheral side of the support walls.

* * * * *